United States Patent [19]

Sato et al.

[11] 4,252,051

[45] Feb. 24, 1981

[54] APPARATUS FOR SUPPORTING PISTON SHOES OF AXIAL PISTON TYPE HYDRAULIC PUMP/MOTOR

[75] Inventors: Masanori Sato, Nagoya; Shigeo Takahaski, Kariya, both of Japan

[73] Assignee: Aisin Seiki Kabushiki Kaisha, Aichi, Japan

[21] Appl. No.: 36,935

[22] Filed: May 7, 1979

[30] Foreign Application Priority Data

May 9, 1978 [JP] Japan ..... 53-61852

[51] Int. Cl.[3] ..... F01B 13/04

[52] U.S. Cl. ..... 91/499

[58] Field of Search ..... 91/485–488, 91/499

[56] References Cited

U.S. PATENT DOCUMENTS

| | | | |
|---|---|---|---|
| 3,289,606 | 12/1966 | Bosch | 91/485 |
| 3,292,553 | 12/1966 | Hann | 91/485 |
| 3,382,793 | 5/1968 | Gantzer | 91/499 |
| 3,906,841 | 9/1975 | Ikyl | 91/487 |

FOREIGN PATENT DOCUMENTS

| | | | |
|---|---|---|---|
| 2119107 | 4/1972 | France | 91/499 |

*Primary Examiner*—William L. Freeh

*Attorney, Agent, or Firm*—Sughrue, Rothwell, Mion, Zinn and Macpeak

[57] ABSTRACT

An improvement of biasing means which urges a piston shoe guide member of an axial piston type hydraulic pump/motor toward a swash plate is provided. Biasing means comprises a plug which is partly inserted into a cylinder bore of a reduced diameter formed in a cylindrical block which receives a plurality of axial pistons, a compressing spring received within the cylinder bore for urging the plug toward the piston shoe guide member, and check valve means which closes the cylinder bore to exert an increased force of reaction upon the piston shoe guide member as the piston shoe guide member drives the plug inwardly and which provides a communication between the cylinder bore and the outside of the cylinder block as the piston shoe guide member tends to move away from the plug. The biasing means functions to maintain piston shoes in abutment against the swash plate, and responds to a movement of the piston shoes toward the cylinder block by producing an increased force in the opposite direction to prevent a movement of the piston shoes away from the swash plate.

3 Claims, 5 Drawing Figures

APPARATUS FOR SUPPORTING PISTON SHOES OF AXIAL PISTON TYPE HYDRAULIC PUMP/MOTOR

BACKGROUND OF THE INVENTION

The invention relates to an axial piston type hydraulic pump/motor which provides an energy translation from or to a static fluid pressure, and more particularly, to an apparatus for supporting piston shoes of the pump-/motor in a manner such that they are urged against the surface of a swash plate.

Fluid pressure translating device of the axial piston type is well known in the art to be often usable either pump or motor (e.g. U.S. Pat. Nos. 3,249,061, Ricketts, and 3,522,759, Martin). Such device usually includes a drive shaft which is associated with either a cylinder block or an inclined and inclinable cam plate to create relative rotational movement between the cylinder block and the cam plate. The cylinder block includes a plurality of pistons in cylinders in an annular array about the axis of the cylinder block. The pistons have inner ends disposed for reciprocation within the cylinders and outer ends adapted to bear against and transmit force to or receive force from the inclined cam plate. In such device where the cylinder block is rotatably mounted, the cylinder block includes passages from each cylinder to an end of the block for association with inlet and outlet passages in a port member or port plate. The inlet and outlet passages of the port member communicate successively with the passages from the cylinders upon relative rotation of the cylinder block with respect to the port member. The cylinder block is positively biased toward the port plate by pressure during the operation of device and by mechanical means supplementing the operating pressure, e.g. during starting of the device.

In hydraulic pumps/motors of the kind described, it is well known to provide an arrangement which may be energized by resilient means to urge piston shoes, which are caused to slide along the surface of a tiltable swash plate, against the latter and to prevent their movement away from the swash plate as forces tending to cause such movement are produced during a switching between the high and low pressure in a valve plate which distributes the hydraulic fluid or during a fluctuation of a charging pressure or variation of the higher pressure as the load changes. A variety of such arrangements are provided (e.g. U.S. Pat. No. 3,249,061, in particular, see FIG. 1). If the piston shoes are urged against the tiltable plate with a force of improper magnitude, they may oscillate on the plate, causing a degradation in the performance and the durability thereof. The prior art solution to this problem has been to utilize a force of sufficient magnitude in the support apparatus associated with piston shoes to oppose any force causing an oscillating movement of piston shoes away from the tiltable plate. However, this prevents a proper abutment from being achieved during normal conditions, and also disadvantageously increases the starting torque of the pump/motor.

SUMMARY OF THE INVENTION

It is a first object of the invention to provide an apparatus for supporting piston shoes which prevents a movement of the piston shoes away from a tiltable swash plate.

It is a second object of the invention to provide an apparatus for supporting piston shoes which prevents oscillations of the piston shoes during the tilting transients and during the normal condition of the tiltable plate.

It is a third object of the invention to provide an apparatus for supporting piston shoes which reduces the magnitude of friction acting between the piston shoes and the tiltable plate in the normal condition when the tiltable plate remains stationary.

The above objects are achieved in accordance with the invention by providing biasing means which urges a piston shoe guide member toward the tiltable swash plate. The biasing means comprises a plug which is partly inserted into a cylinder bore of a reduced diameter formed in a cylinder block which receives a plurality of axial piston, a compression spring disposed within the cylinder bore for urging the plug toward the piston shoe guide member, and check valve means which closes the cylinder bore to produce an increased force of reaction upon the piston shoe guide member as the latter drives the plug inwardly and which provides a communication between the cylinder bore and the outside of the cylinder block as the guide member tends to move away from the plug.

DESCRIPTION OF PREFERRED EMBODIMENTS

Figure 1:
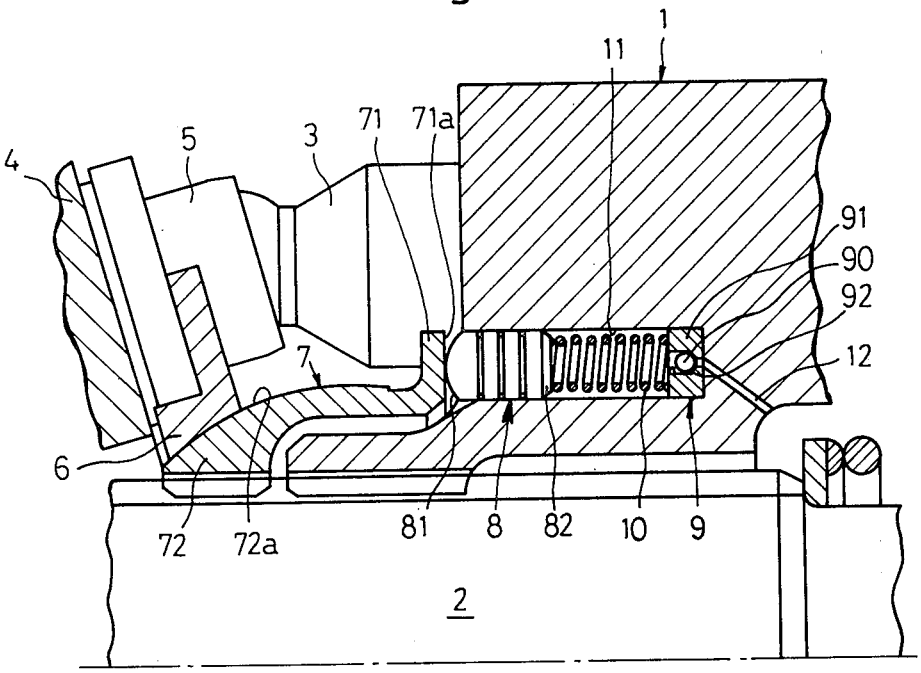
FIG. 1 is a partial longitudinal section of an axial piston type hydraulic pump/motor incorporating a preferred embodiment of the invention.

Referring to FIG. 1, a first embodiment of the invention will be described. An axial piston type hydraulic pump/motor, abbreviated hereafter as pump/motor, incorporating a tiltable swash plate comprises a cylinder block 1 which is splined to a main transmission shaft 2 to permit an oscillation and an axial sliding movement relative to the shaft 2 and also an integral rotation therewith. A plurality of pistons 3 are disposed in a corresponding number of axial cylinders, not shown, which are distributed at an equal interval circumferentially of the cylinder block 1, and are capable of an axial reciprocating movement therein. The left-hand end of each piston 3 is rockably engaged by a piston shoe 5 with a spherical bearing, now shown, interposed therebetween. A tiltable swash plate 4 is arranged so as to be disposed at a varying angle with respect to the shaft 2, and individual piston shoes 5 bear against and slide along the sliding surface of the tiltable plate.

A guide member 7 having a flange 71 and a spherical portion 72 is splined to the shaft 2 so as to be capable of sliding movement in the axial direction thereof for integral rotation therewith, and is disposed between the cylinder block 1 and the tiltable plate 4. The spherical portion 72 has a spherical surface 72*a* which provides a bearing for a retainer 6 supporting each piston shoe 5 so that the retainer can be rocked in accordance with a tilting movement of the tiltable plate. The flange 71 has a flat end face 71*a* which bears against the left-hand end face 81 of a plug 8. As will be described later, the flange 71 is maintained in abutting engagement with the plug 8. Each plug 8 is slidably received in one of a plurality of axial cylinder bores 11 of a reduced diameter which are disposed at an equal interval along the circumference of the cylinder block 1, but phase displaced from the first mentioned axial cylinders. Check valve means 9 is mounted in the bottom of the cylinder bore 11, and resilient means, i.e., compression spring 10, is disposed between the right-hand end 82 of the plug 8 and the left-hand end face of the check valve means 9 to urge the guide member 7 to the left or toward the tiltable plate 4. In this manner, the retainer 6 is also urged through the guide member 7 to cause an abutment of each piston shoe 5 against the sliding surface of the swash plate 4. As is well known in the art of the check valve, check valve means 9 comprises a ball 90 which is received in a casing 91 having a pair of cylindrical surfaces of different diameters which are joined by a conical surface 92. The ball 90 bears against the conical surface, and as the plug 8 is driven outward, the ball 90 moves away from the conical surface to provide a communication of the internal chamber of the cylinder bore 11 with the outside through a passage 12, thus assisting in the outward movement of the plug 8. Conversely, as the plug 8 is driven inward, the ball 90 is driven into abutment against the conical surface to interrupt the described communication, and thus restricts the inward movement of the plug 8.

In operation, the cylinder block 1 is driven for rotation to cause a reciprocating movement of the respective pistons 3, whereby the entire arrangement operates as either pump or motor to effect energy translation from or to a static fluid pressure, as is well known in the art. During such operation, if forces of oscillating nature are produced which cause a movement of the individual piston shoe 5 away from the sliding surface of the swash plate 4 during a switching between the high and low pressure of a valve plate which distributes the hydraulic fluid or during a fluctuation in the charging pressure or variations of a higher pressure as the load changes, the retainer 6 will be driven to the right, as viewed in this Figure, causing the plug 8 to be driven inward into the associated cylinder bore through the guide member 7. However, the inward movement of the plug 8 is restricted as mentioned above, thus preventing a movement of the respective piston shoes 5 away from the sliding surface of the swash plate 4. During a normal condition when no such forces of oscillating nature are produced, the resilience of compression spring 10 is effective to urge the individual piston shoes 5 against the sliding surface of the swash plate 4 with a force of proper magnitude, allowing their sliding movement along the sliding surface.

Figure 2:
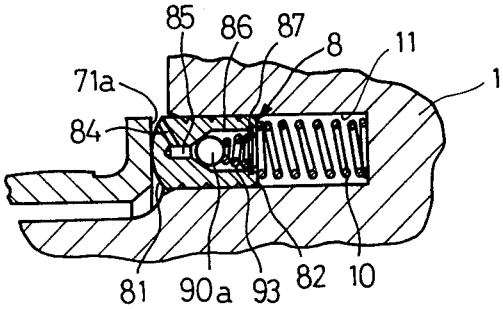
FIGS. 2, 3, 4 and 5 are fragmentary, longitudinal sections of axial piston type hydraulic pumps/motors employing other embodiments of the invention.

Referring to FIG. 2, there is shown a second embodiment of the invention in which the check valve means which has been disposed in the bottom end of the cylinder bore 11 in the first embodiment is assembled within the plug 8. Specifically, the plug 8 is formed with a cylinder 85 of a reduced diameter and another cylinder 86 of an increased diameter which are joined together by a conical surface. A spring 93 is disposed between a ball 90*a* and a spring retainer 87 to urge the ball against the conical surface. A passage 84 opens into the left-hand end face of the plug in a region where it is clear from the flat surface 71*a* of the flange 7, and communicates the cylinder 85 with the exterior. With this arrangement, as the plug 8 tends to move outward under the resilience of the compression spring 10, the ball 90*a* is displaced from the conical surface against the resilience of spring 93, whereby the internal chamber of the cylinder 11 communicates with the exterior, thus assisting in the outward movement of the plug 8. As the plug 8 moves inward, the ball 90*a* abuts against the conical surface to restrict the inward movement of the plug.

Figure 3:
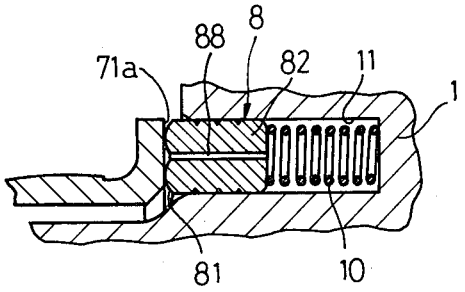

FIG. 3 shows a third embodiment in which the function of the check valve 9 shown in the first embodiment is replaced by a passage 88 formed to extend through the plug 8 and opening into a region of the left-hand end face 81 of the plug which can be closed by the flat surface 71*a* of the flange 7, the other end of the passage communicating with the internal chamber of the cylinder bore 11. When the plug 8 is urged to the right by the flange 7, the degree of sealing attained by the abutment of the flange 7 against the plug 8 increases to block the passage 88, thus restricting the inward movement of the plug 8 in the same manner as in the first embodiment. When the plug 8 is released from a force which tends to urge it to the right, the degree of sealing decreases to allow communication between the internal chamber of the cylinder bore 11 and the exterior through the passage 88 and the abutting surfaces, whereby the plug 8 is enabled by the compression spring 10 to move outward, thus driving the flange 7 to the left.

Figure 4:
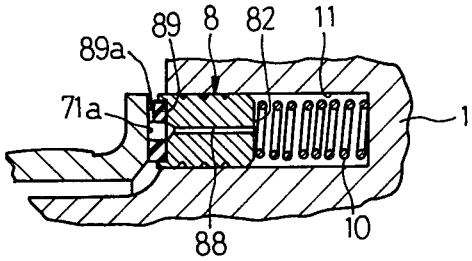

FIG. 4 shows a fourth embodiment of the invention which represents a modification of the embodiment shown in FIG. 3. Specifically, resilient plate 89 is mounted on the left-hand end of the plug 8 for abutment against the flat surface 71*a* of the flange 7. A channel 89*a* is formed in the surface of the resilient plates 89 which is adapted to bear against the surface 71*a*. A passage 88 opens into the left-hand end face of the plug 8 where a central opening is formed. In this manner, communication can be achieved between the internal chamber of the cylinder bore 11 and the exterior through the channel 89*a* and the passage 88. If the plug 8 is urged to the right by the flange, the resilient plate 89 undergoes an elastic deformation to squeeze the channel 89*a*, thus restricting the inward movement of the plug while facilitating its outward movement in the same manner as in the third embodiment.

Figure 5:
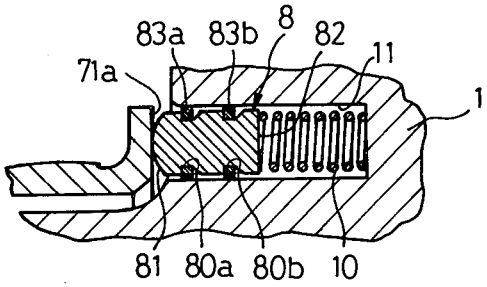

FIG. 5 shows a fifth embodiment of the invention where the cylindrical outer surface of the plug 8 is formed with a pair of axially spaced, circumferentially extending grooves 80*a*, 80*b* in which resilient members 83*a*, 83*b* are mounted. The plug 8 slidably fits in the cylinder bore 11, and when it moves outward, the resilient members 83*a*, 83*b* are elastically deformed in the axial direction toward relieved regions formed by the right-hand tapered surfaces, as viewed in FIG. 5, of the circumferential grooves 80*a*, 80*b*, thus decreasing the drag and the frictional resistance and reducing the degree of fitting to permit a communication between the internal chamber of the cylinder bore 11 and the exterior through the fitting surfaces, thus assisting in the outward movement of the plug 8. As the plug 8 is driven inward, the absence of described functioning of the tapered surfaces prevents an elastic deformation from occurring, so that the degree of fitting is increased to seal the cylinder bore 11, whereby the frictional resistance between the fitting surfaces increase to restrict the inward movement of the plug 8.

The operation of the pump/motor which incorporates any one of the second to the fifth embodiments is similar to that achieved with the first embodiment, and hence will not be described.

From the foregoing description, it will be appreciated that in accordance with the invention, means is provided which restrict a movement of the plug, forming part of the apparatus for supporting piston shoes, in one direction, thus restricting the inward movement of the plug into the cylinder bore while facilitating its outward movement. The provision of such means prevents a movement of the piston shoes away from the sliding surface of the swash plate if oscillating forces are produced which tend to move the piston shoes away from the sliding surface. The resilient means or compression spring 10 may have a resilience which is chosen to be of a sufficient magnitude to cause the piston shoes abut against the sliding surface of the swash plate under the normal condition when no oscillating forces are applied to the piston shoes. This facilitates a design of the resilient means and also reduces the starting torque of the pump/motor.

What is claimed is:

1. An apparatus for supporting piston shoes of an axial piston type hydraulic pump/motor including a main transmission shaft, a cylinder block splined to the shaft for integral rotation therewith, a plurality of axial cylinders formed in the cylinder block at an equal interval in the circumferential direction thereof, a plurality of pistons slidably fitted in each of the cylinders, a plurality of piston shoes rockably engaging with an end of respective piston through a spherical bearing, a tiltable swash plate disposed at a variable angle with respect to the main transmission shaft, and a guide member urging the piston shoes against the sliding surface of the swash plate; the apparatus comprising a plug which is partly inserted into an axial cylinder bore of a reduced diameter formed in the cylinder block, a compression spring received within the cylinder bore for urging the plug toward the piston shoe guide member, and a check valve means which interrupts a communication of the internal space of the axial cylinder bore with the outside of the cylinder block as the plug moves in a direction to compress the compression spring and which provides a communication between the internal space of the cylinder bore and the outside of the cylinder block as the plug moves in the opposite direction, wherein said check valve means comprises a passage extending through the plug and opening into a central region of a surface of the plug which is adapted to bear against the guide member.

2. An apparatus for supporting piston shoes of an axial piston type hydraulic pump/motor including a main transmission shaft, a cylinder block splined to the shaft for integral rotation therewith, a plurality of axial cylinders formed in the cylinder block at an equal interval in the circumferential direction thereof, a plurality of pistons slidably fitted in each of the cylinders, a plurality of piston shoes rockably engaging with an end of respective piston through a spherical bearing, a tiltable swash plate disposed at a variable angle with respect to the main transmission shaft, and a guide member urging the piston shoes against the sliding surface of the swash plate; the apparatus comprising a plug which is partly inserted into an axial cylinder bore of a reduced diameter formed in the cylinder block, a compression spring received within the cylinder bore for urging the plug toward the piston shoe guide member, and a check valve means which interrupts a communication of the internal space of the axial cylinder bore with the outside of the cylinder block as the plug moves in a direction to compress the compression spring and which provides a communication between the internal space of the cylinder bore and the outside of the cylinder block as the plug moves in the opposite direction, wherein said check valve means comprises a passage extending through the plug, and a resilient plate fixedly mounted on an end face of the plug which is located opposite to the guide member and having an opening formed therein which communicates with the passage and having a channel formed in the end face thereof located opposite to the guide member which communicates with the opening.

3. An apparatus for supporting piston shoes of an axial piston type hydraulic pump/motor including a main transmission shaft, a cylinder block splined to the shaft for integral rotation therewith, a plurality of axial cylinders formed in the cylinder block at an equal interval in the circumferential direction thereof, a plurality of pistons slidably fitted in each of the cylinders, a plurality of piston shoes rockably engaging with an end of respective piston through a spherical bearing, a tiltable swash plate disposed at a variable angle with respect to the main transmission shaft, and a guide member urging the piston shoes against the sliding surface of the swash plate; the apparatus comprising a plug which is partly inserted into an axial cylinder bore of a reduced diameter formed in the cylinder block, a compression spring received within the cylinder bore for urging the plug toward the piston shoe guide member, and a check valve means which interrupts a communication of the internal space of the axial cylinder bore with the outside of the cylinder block as the plug moves in a direction to compress the compression spring and which provides a communication between the internal space of the cylinder bore and the outside of the cylinder block as the plug moves in the opposite direction, wherein said check valve means comprises a tapered circumferentially extending groove formed in the outer surface of the plug, and an annular resilient member fitted in the groove.

* * * * *